US005463195A

United States Patent [19]

Watanabe et al.

[11] Patent Number: 5,463,195

[45] Date of Patent: Oct. 31, 1995

[54] KEY SWITCH

[75] Inventors: Makoto Watanabe, Nagoya; Isao Mochizuki, Kaizu; Yoshitsugu Sato, Kuwana; Takeyuki Takagi, Nagoya; Hiroaki Okada, Kasugai, all of Japan

[73] Assignee: Brother Kogyo Kabushiki Kaisha, Nagoya, Japan

[21] Appl. No.: 172,259

[22] Filed: Dec. 23, 1993

[30] Foreign Application Priority Data

Jan. 6, 1993 [JP] Japan ..... 5-00685
Feb. 5, 1993 [JP] Japan ..... 5-018711

[51] Int. Cl.[6] ..... H01H 3/12

[52] U.S. Cl. ..... 200/5 A; 200/344; 200/517

[58] Field of Search ..... 200/4, 5 A, 17 R, 200/18, 16 R, 512, 517, 329, 332, 335, 341, 344, 345

[56] References Cited

U.S. PATENT DOCUMENTS

| | | | |
|---|---|---|---|
| 2,550,250 | 4/1951 | Huppert | 200/159 |
| 3,174,685 | 3/1965 | Swanson | 235/54 |
| 3,849,611 | 11/1974 | Walker, Jr. | 200/5 A |
| 4,000,389 | 12/1976 | Misson et al. | 200/292 |
| 4,433,225 | 2/1984 | Cowles | 200/5 A |
| 4,560,844 | 12/1985 | Takamura et al. | 200/5 A |
| 4,560,845 | 12/1985 | Takamura et al. | 200/5 A |
| 4,580,022 | 4/1986 | Oelsch et al. | 200/340 |
| 4,709,128 | 11/1987 | Odagawa | 200/340 |
| 4,735,520 | 4/1988 | Suzuki et al. | 400/488 |
| 4,902,862 | 2/1990 | Oelsch et al. | 200/344 |
| 5,278,372 | 1/1994 | Takagi et al. | 200/344 |
| 5,280,147 | 1/1994 | Mochizuki et al. | 200/344 |

FOREIGN PATENT DOCUMENTS

| | | | |
|---|---|---|---|
| 4-51388 | 12/1992 | Japan | H01H 13/14 |

*Primary Examiner*—Kristine L. Kincaid
*Assistant Examiner*—Michael A. Friedhofer
*Attorney, Agent, or Firm*—Oliff & Berridge

[57] ABSTRACT

A key switch of the invention includes a key top having a face on which various characters are displayed and a back face having an engaging portion, a guide support member having two hinge members and a holder plate. The holder plate is provided with support portions which are elastically moved when pushed down by the lower portion of the guide support member to pinch and support the lower portion, and further the engaging portions of the key top can also pinch and support the upper portion of the guide support member by pushing the upper portion. Accordingly, according to the key switch, the fabrication of the guide support member and the holder plate and the fabrication of the guide support member and the key top can be extremely easily performed, and the operating performance of the key top is improved.

20 Claims, 10 Drawing Sheets

KEY SWITCH

BACKGROUND OF THE INVENTION

1. Field of the Invention

This invention relates to a key switch which is used for a well-known key board for a computer or the like.

2. Description of Related Art

In general, a conventional key switch is so designed that a key stem which is provided so as to be vertically projected from the back face (surface) of a key top is upwardly and downwardly slidably inserted into a key holder portion formed on a holder plate. With the key switch thus constructed, if the key stem has a relatively-large portion to be slidably guided by the key holder portion, a key-operating performance would be more improved. However, in this case the requirement to thin the key board (reduce the thickness of the key board) cannot be satisfied. On the other hand, if the portion of the key stem to be slidably guided is designed to be of a small size (to be thinner) in order to satisfy the requirement to thin the key board, the key-operating performance declines due to "tanglement (friction)" occurring between the key stem and the key holder portion.

In order to solve the above problems of the conventional key switch, as disclosed in the Japanese Patent Application No. 3-330160 (corresponding to U.S. Pat. Nos. 5,280,147 and 5,278,372, the inventor of this application proposed a key switch in which the thinning of the key board was achieved by removing the key stem and the key holder portion at the same time the key-operating performance was improved.

The construction of the key switch as described above will be described with reference to FIGS. 14 to 16.

As shown in FIG. 14, the key switch comprises a key top 101, a guide support member 106 and a base portion 150. The key top 101 is formed of a resin and comprises two pairs of engaging portions 102 and 103, engaging holes 104 formed in the engaging portions 102, and engaging grooves 105 formed in the engaging portions 103.

The base portion 150 is designed in a three-layered structure and has a holder plate 125, a flexible circuit board 130 and a switch support plate 132. On the holder plate 125 are provided two pairs of engaging portions 126 and 127, engaging grooves 128 formed in the engaging portions 126, and engaging holes 129 formed in the engaging portions 127 for each key top 101. On the flexible circuit board 130 is provided a switch electrode (not shown) for each key top 101. Further, a rubber spring 131, containing a movable electrode, is provided so as to cover each of the switch electrodes. The switch support plate 132 has a degree of rigidity, and it is used to support the holder plate 125 and the flexible circuit board 130.

The guide support member 106 provided between the key top 101 and the base portion 150 is formed of two resin hinge members 107 and 108. As shown in FIG. 15, the first hinge member 107 comprises a base portion 109 and two base end portions 110 and 111 which are formed at both ends of the base portion 109 so as to be integral with the base portion 109. A shaft 112 is formed projectingly from the one side surface of a central portion of the base portion 109 and is supported while being inserted into a shaft hole 120 which is formed in the second hinge member 108. Further, the base portion 110 is provided with engaging pins 113 and 114 which project from the side surfaces of both end projecting portions 110A of the base portion 110. The engaging pins 113 and 114 are rotatably inserted into the engaging holes 104 formed in the engaging portions 102 of the key top 101. Further, the base end portion 111 is designed to be substantially U-shaped in plan view. Engaging pins 115 and 116 are provided projectingly from the side surfaces of both end projecting portions 111A of the U-shaped base end portion 111. The engaging pins 115 and 116 are slidably engaged with the engaging grooves 128 of the engaging portions 126 formed in the holder plate 125.

As shown in FIG. 16, the second hinge member 108 comprises a base portion 117 and two base end portions 118 and 119, which are formed at both ends of the base portion 117 so as to be integral with the base portion 117. A shaft hole 120 is formed at the center portion of the base portion 117. The shaft 112 of the hinge member 107, as described above, is inserted into the shaft hole 120. The base end portion 118 is designed to be substantially U-shaped in plan view. Engaging pins 121 and 122 are provided projectingly from both end projecting portions 118A of the U-shaped base end portion 118. The engaging pins 121 and 122 are rotatably inserted into the engaging holes 129 of the engaging portions 127 formed in the holder plate 125. Further, engaging pins 123 and 124 are provided projectingly from both end projecting portions 119A of the base end portion 119. The engaging pins 123 and 124 are slidably engaged with the engaging grooves 105 formed in the engaging portions 103 of the key top 101 as described above.

The guide support member 106 is constructed by inserting the shaft 112 formed in the base portion 109 of the first hinge member 107 into the shaft hole 120 formed in the base portion 117 of the second hinge member 108. Both of the hinge members 107 and 108 are mutually rotatable around a shaft support portion 106A comprising the shaft 112 and the shaft hole 120. Accordingly, the key top 101 is linked to the base portion 150 so as to be vertically movable. In addition, since the shaft support portion 106A is ordinarily disposed at the upper side of the rubber spring 131, the rubber spring 131 is buckled through the shaft support portion 106A of both hinge members 107 and 108 by pushing down the key top 101. Accordingly, the key switch thus constructed is so designed that the switching operation thereof is executed by short-circuiting the switch electrode using the movable electrode.

However, the conventional key switch as described above has a problem in that the assembly of the holder plate 125 and the guide support member 106 comprising the two hinge members 107,108 and the assembly of the guide support member 106 and the key top 101 cannot be simply and easily performed.

That is, in the case where the key switch as described above is assembled by a worker, the key switch must be assembled in accordance with the following procedure. First, the worker needs to assemble the first and second hinge members 107 and 108 so as to be intersected with each other, thereby constituting the guide support member 106. Subsequently, the worker press-fits both of the engaging pins 121 and 122 of the base end portion 118 of the second hinge member 108 into the engaging holes 129 of the engaging portions 127 of the holder plate 125. At this time, the press-fitting of the engaging pins 121 and 122 into the engaging holes 129 is carried out using the mutual resin elasticity of the end projecting portions 118A and the engaging pins 121 and 122. However, it is difficult for the worker to position each of the engaging pins 121 and 122 to the engaging holes 129. Therefore, the press-fitting work is carried out under a very instable condition and is very cumbersome.

In addition, in the case where the worker press-fits the engaging pins 115 and 116 of the base end portion 111 of the first hinge member 107 into the engaging grooves 128 of the engaging portions 126, the press-fitting work is also carried out using the mutual resin elasticity of the end projecting portions 111A and the engaging pins 115 and 116, so that this working is also cumbersome like the above press-fitting work.

As described above, the assembly of each hinge member 107, 108 with each engaging portion 126, 127 of the holder plate 125 is finished. Thereafter, each of the engaging pins 113 and 114 is press-fitted into the engaging holes 104 of the engaging portions 102 and each of the engaging pins 115 and 116 is press-fitted into engaging grooves 105. These press-fittings are also carried out using the mutual resin elasticity of the engaging pins 113,114,123,124 and the engaging portions 102,103. Thus these assembly operations are also cumbersome like the previously described assembly.

As described above, according to the key switch as disclosed in the specification and the drawings of the Japanese Patent Application No. 3-330160, the thinning of the key switch is more achievable and the key-operating performance thereof can be excellently improved as compared with the key board of the conventional key switch. However, for this key switch, the assembly of the hinge members 107,108 and the holder plate 125 and the key top 101 is carried out using the resin elasticity, and each of the engaging pins 113 through 116 and 121 through 124 is required to be fitted to the appropriate engaging hole 104,129 or engaging groove 105,128 while being positioned to the inside of that engaging hole or groove. Therefore, the complicated press-fitting work must be carried out for the entire assembly of the key switch.

SUMMARY OF THE INVENTION

An object of this invention is to provide a key switch in which fabrication of a guide support member and a holder plate and fabrication of the guide support member and a key top are easily performed, while the thinning of the key board is achieved and also providing excellent operational performance of the key.

In order to attain the above object, the key switch according to the invention includes a key top having an obverse face on which characters, etc. can be displayed, a back face at the opposite side of the obverse face, an engaging portion on the back face, a guide support member which comprises upper and lower portions and guides the key top so as to be movable upwardly and downwardly, the upper portion of the guide support member being engaged with the engaging portion of the key top, a holder member which is disposed at the lower side of the key top, a support member which is provided to the holder member and is elastically moved when it is pushed by the lower portion of the guide support member to thereby pinch the lower portion of the guide support member, and a switching member which is actuated interlockingly with the vertical motion of the key top.

According to the key switch of the invention thus constructed, the upper portion of the guide support member is engagedly secured to the key top and the lower portion of the guide support member is supported by the support portion of the holder member, so that the key top is vertically movably supported by the guide support member. The switching member carries out the switching operation through the vertical motion of the key top. The support portion of the holder member is elastically moved when it is pushed by the lower portion of the guide support member, whereby the lower portion of the guide support member is pinched and supported by the support portion. Accordingly, in the key switch of the invention, the fabrication of the guide support member and the holder member is facilitated, and the operational performance thereof is improved.

BRIEF DESCRIPTION OF THE DRAWINGS

A preferred embodiment of the invention will be described in detail with reference to the following figures wherein.

DETAILED DESCRIPTION OF THE PREFERRED EMBODIMENTS

Preferred embodiments according to the invention will be hereunder described with reference to the accompanying drawings.

A first embodiment of a key switch according to this invention will be described with reference to FIGS. 1 through 8.

Figure 1:
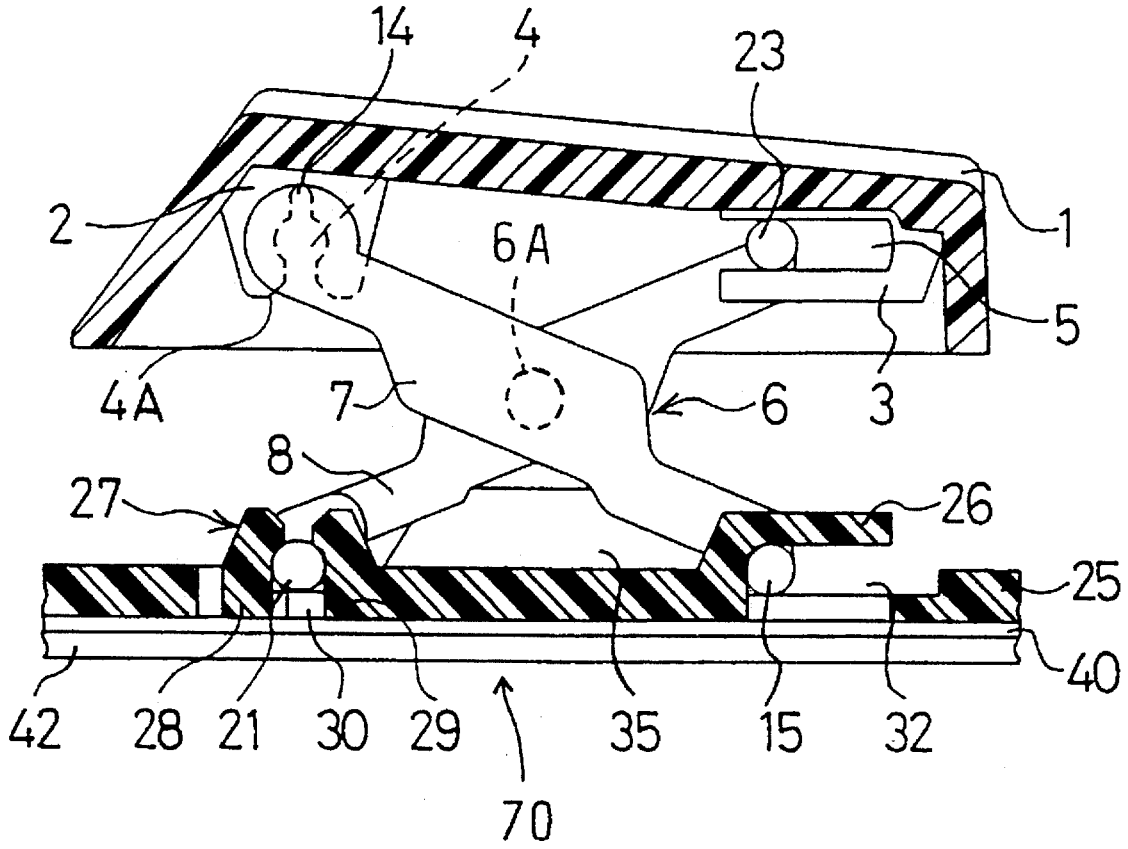
FIG. 1 is a cross-sectional view of a key switch of a first embodiment according to the invention.
Figure 2A:
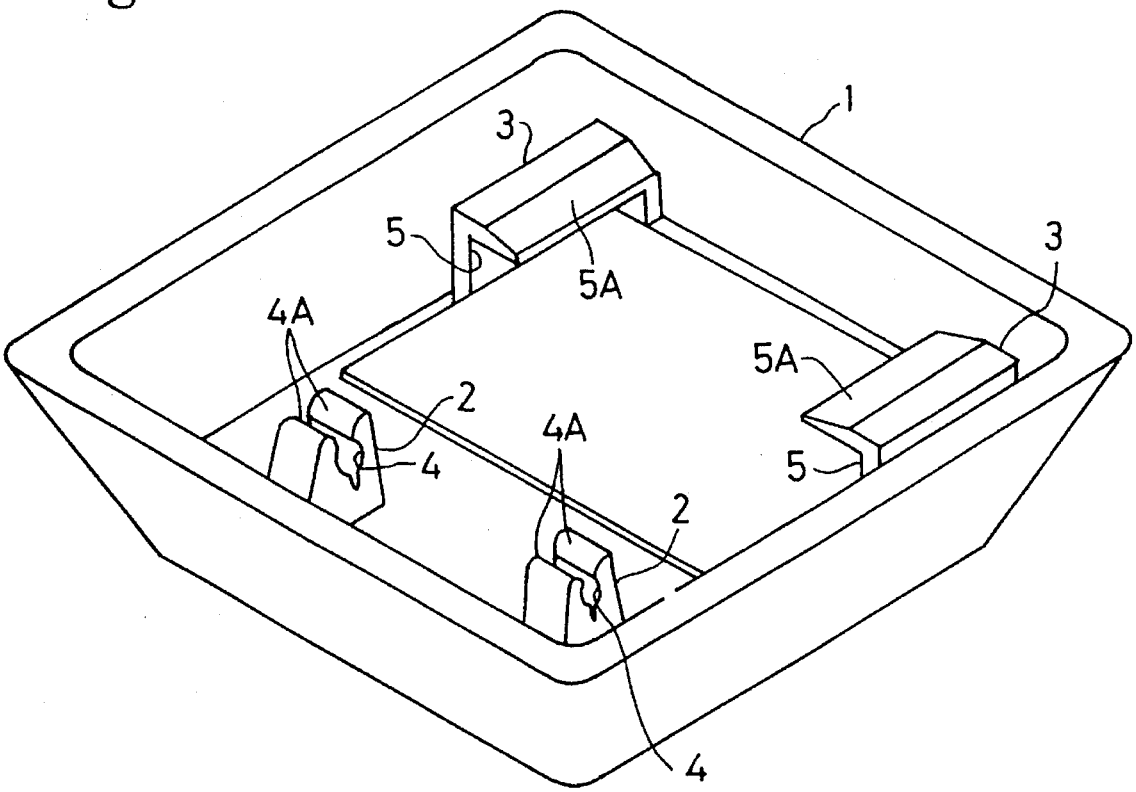
FIG. 2A is a perspective view of the back face side of a key top which is used for the key switch of the first embodiment.
Figure 2B:
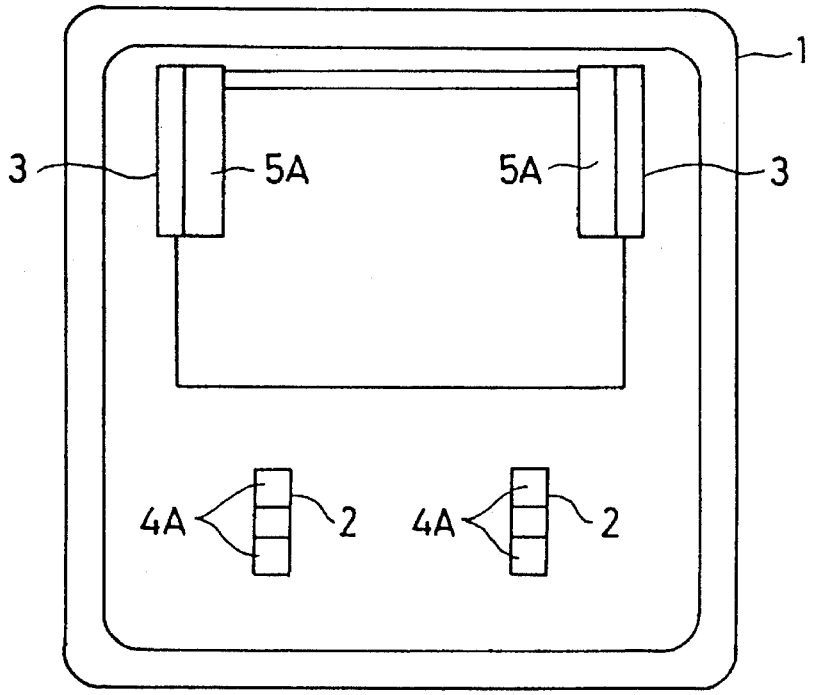
FIG. 2B is a plan view of the back face side of the key top which is used for the key switch of the first embodiment.

The key switch comprises a key top 1, a guide support member 6 and a base portion 70. The key top 1 is formed of a synthetic resin, such as ABS resin, by a molding method. Characters, such as alphabetic or the like (not shown), are provided on the upper surface of the key top 1 by a printing method or the like. Two engaging portions 2 and 3 are formed integrally with the main body of the key top 1 on the back face side of the key top 1. As shown in FIGS. 2A to 2B, respective pairs of the engaging portions 2 and 3 are provided.

Each of the engaging portions 2 is formed with a substantially circular engaging groove 4. The engaging groove 4 is engaged with an engaging bar 13 which is formed at one end of a first hinge member 7 as described later, so that the engaging bar 13 is rotatably supported by the engaging groove 4. An engaging guide portion 4A is openly formed at the open side of the engaging groove 4 in such a manner as to be continuous to the engaging groove 4 and gradually widened toward the side away from engaging groove 4. The engaging guide portion 4A is formed to have a smooth curved surface so that it serves to smoothly guide the engaging bar 13 into the engaging groove 4 when the engaging bar 13 of the hinge member 7 is to be engagedly inserted into the engaging groove 4. Further, a slender groove 14 is formed at the lower side of the engaging groove 4 in such a manner as to be continuous to a part of the engaging groove 4. The slender groove 14 enables the engaging portion 2 to be easily opened, and thus the engaging bar 13 dan be easily inserted into the engaging groove 4.

Each of the engaging portions 3 is formed with an engaging groove 5. Engaging pins 23,24 are formed at one end of a second hinge member 8 to engage with the engaging groove 5 so as to be slidable in a horizontal direction. An engaging guide portion 5A serving as a smooth slant surface is formed at the opposite side surface of the engaging portion to the engaging groove 5. When the engaging pins 23,24 of the second hinge member 8 are engagedly inserted into the engaging grooves 5, the engaging guide portion 5A serves to push the engaging pins 23,24 to the inside of the engaging grooves 5, whereby the engaging pins 23,24 are smoothly guided toward the engaging groove 5 by the engaging guide portion 5A. At the lower side of the key top 1 is disposed the guide support member 6 for guiding the upward and downward motion of the key top while supporting the key top. The guide support member 6 comprises the two hinge members 7,8.

Figure 3:
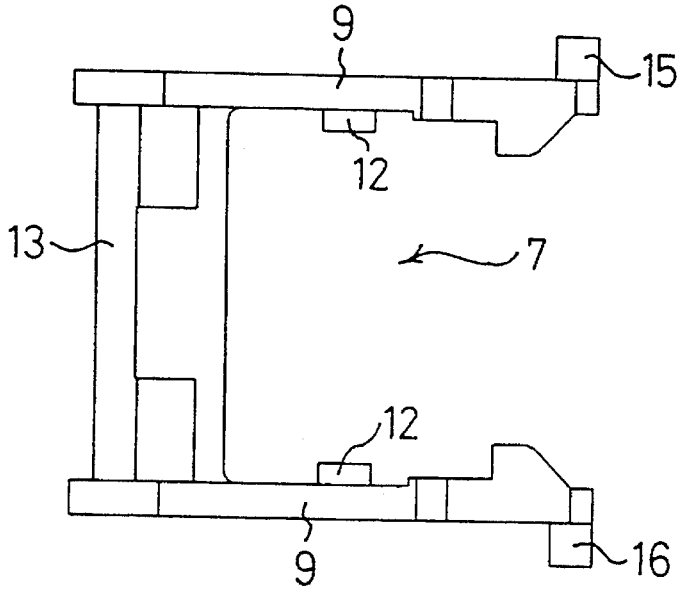
FIG. 3 is a plan view showing the structure of a first hinge member which is used for the key switch of the first embodiment.

As shown in FIG. 3, the first hinge member 7 is formed in a substantially U-shape as viewed in plan. The hinge member 7 includes a pair of plate members 9. An engaging bar 13 is integrally formed with one end of the plate members 9. Further, engaging pins 15,16 are respectively provided to the plate members 9 so as to extend outwardly from the other ends of the plate members 9, respectively. The engaging bar 13 is movable along the engaging guide portion 4A to be engagedly inserted into the engaging grooves 4 of the engaging portions 2 of the key top 1 and rotatably supported by the engaging grooves 4. The respective engaging pins 15,16 are slidably engaged with an engaging portion 26 formed in a holder plate 25 as described later. A pair of shafts 12 are provided at the central portions of the plate members 9, which oppose one another, and, thus, the shafts 12 project from the plate members 9 to confront one another. The shafts 12 are pivotally supported by shaft holes 20 (as described later) formed in the second hinge member 8. The engaging bar 13 and the engaging pins 15,16 of the first hinge member 7 is so designed that the distance from the engaging bar 13 to the shafts 12 is equal to the distance from the engaging pins 15,16 to the shafts 12.

Figure 4:
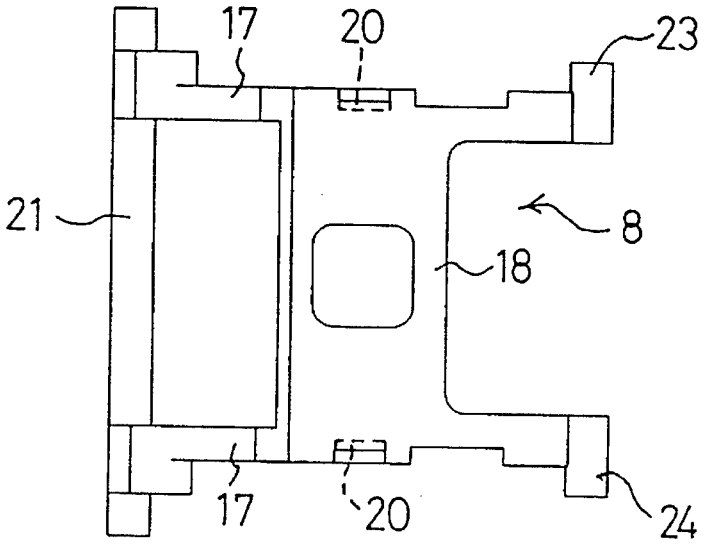
FIG. 4 is a plan view showing the structure of a second hinge member which is used for the key switch of the first embodiment.

As shown in FIG. 4, the second hinge member 8 includes a pair of opposing plate members 17. An engaging bar 21 is integrally formed at one end of the plate members 17. Further, engaging pins 23,24 are formed on the plate members 17 to extend outwardly from the other end of the plate members 17. Both end portions of the engaging bar 21 are rotatably supported by a pinch portion 27 of the holder plate 25 (as described later), and each of the engaging pins 23,24 is slidably engaged with the engaging groove 5 of the engaging portion 3 through the use of the engaging guide portion 5A.

A pair of shaft holes 20 are formed at the central portion of the outside of the plate members 17 so as to be aligned with one another. The shaft holes 20 are rotatably engaged with the shafts 12 formed in the plate members 9 of the first hinge member 7 as described above. The shafts 12 and the shaft holes 20 constitute the shaft support portion 6A. With this construction, the hinge members 7 and 8 are rotatably intersected to each other around the shaft support portion 6A. The engaging bar 21 and the engaging pins 23,24 of the second hinge member 8 are so designed that the distance from the shaft holes 20 to the engaging bar 21 is equal to the distance from the shaft holes 20 to the engaging pins 23,24. A push-down portion 18 is provided between the central portion of the plate members 17. The push-down portion 18 is ordinarily disposed at the upper side of a rubber spring 35, described later, and pushes the rubber spring 35 downwardly in association with the mutual rotation of the hinge members 7,8 when the key top 1 is pushed down. Through this operation, the push-down portion 18 pushes down the rubber spring 35 in conjunction with the depression of the key top 1 to carry out the switching operation.

The base portion 70 is designed in a three-layered structure comprising a holder plate 25, a flexible circuit board 40 and a switch support plate 42. The holder plate 25 is provided with two engaging portions 26 and two pinch portions 27 for each switch device (in FIG. 1, only one engaging portion 26 and one pinch portion 27 are illustrated). The engaging portion 26 is formed with a slide groove 32 which is designed to be opened at the right side of FIG. 1. Each of the engaging pins 15,16, formed in the first hinge member 7, is slidably inserted into a slide groove 32. Each of the pinch portions 27 comprises a first guide portion 28 and a second guide portion 29. A slide groove 30 is formed at the substantially center position between the guide portions 28,29. The end portions of the engaging bar 21 formed at the end of the second hinge member 8 are rotatably inserted into the slide grooves 30. The first guide portion 28 has a space or groove between it and the body of the holder plate 25 whereas the second guide portion 29 is solid with the body of the holder plate 25.

Figure 7:
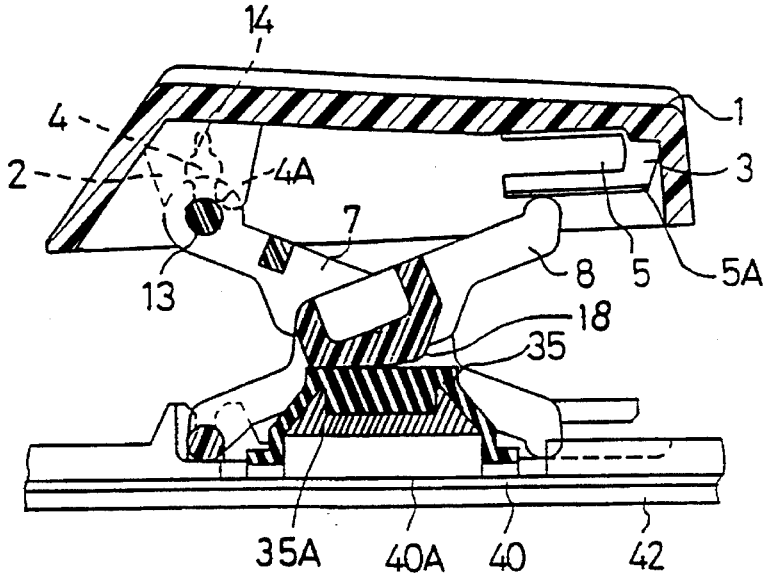
FIG. 7 is a schematic diagram showing a state where a key top is mounted on the guide support member used for the key switch of the first embodiment.

The flexible circuit board 40 is formed with a switch electrode 40A (see FIG. 7) for each key switch and is disposed at the lower side of the holder plate 25. In correspondence with the switch electrode 40A, a rubber spring 35 having an inverse cup-shaped section is mounted on the flexible circuit board 40. Further, a movable electrode 35A (see FIG. 7) is fixedly secured to the inner top wall of the rubber spring 35 so as to confront the switch electrode 40A on the circuit board 40. The push-down portion 18 formed in the second hinge member 8 is mounted over the rubber spring 35 (as shown in FIG. 7). Accordingly, when the push-down portion 18 is depressed in conjunction with the depression of the key top 1, the rubber spring 35 is compressed by the push-down portion 18. If the compression amount exceeds a predetermined amount, the rubber spring 35 is buckled and the movable electrode 35A and the switch electrode 40A on the flexible circuit board 40 contact. Accordingly, the switch electrode 40A is short-circuited, through the contact between the movable electrode 35A and the switch electrode 40A on the flexible circuit board 40, whereby the switching operation is carried out.

The switch support plate 42 is disposed at the lower side of the flexible circuit board 40. The switch support plate 42 supports the flexible circuit board 40 and the holder plate 25 which are disposed on the upper surface of the switch support plate 42, thereby improving rigidity of the flexible circuit board 40 and the holder plate 25. Any material plate may be used for the switch support plate 42 insofar as it has a degree of rigidity. If the switch support plate 42 is formed of a metal plate, that is, it comprises an aluminum plate, an iron plate or the like, any noise occurring from any circuit disposed at the lower portion of the base portion 70 can be shielded by the metal plate.

Next, a method for assembly of the key switch of the first embodiment will be described with reference to FIGS. 5 to 8.

First, a worker assembles the base portion 70. That is, the worker mounts the flexible circuit board 40 and the holder plate 25 on the switch support plate 42.

Subsequently, the worker inserts the shafts 12 of the first hinge member 7 into the corresponding shaft holes 20 of the second hinge member 8 to assemble the guide support member 6. Actually, a number of guide support members 6 are required, and it is preferable that a number of guide support members 6 be assembled ahead of time.

Figure 5:
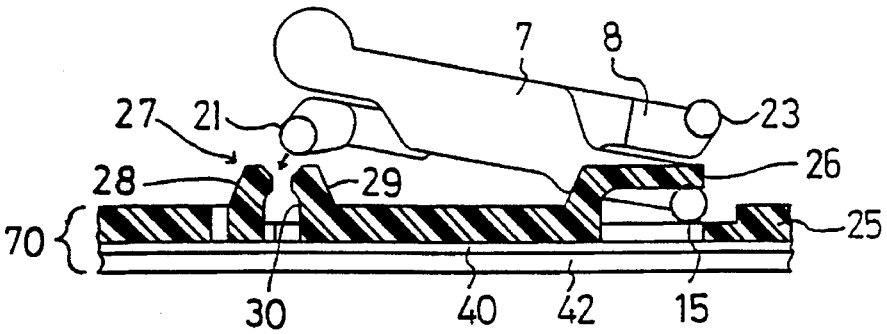
FIG. 5 is a schematic diagram showing a state where a guide support member used for the key switch of the first embodiment is being linked to a holder plate.
Figure 6:
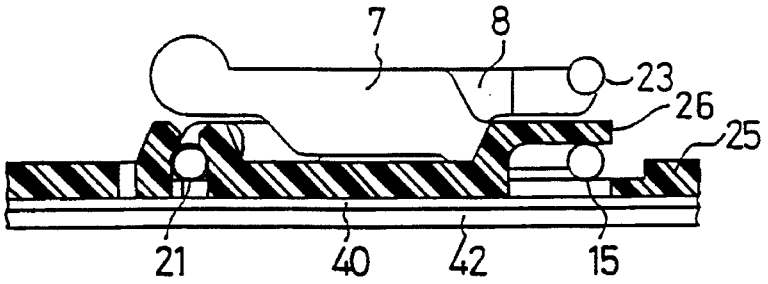
FIG. 6 is a schematic diagram showing a state after the guide support member used for the key switch of the first embodiment is linked to the holder plate.

Thereafter, as shown in FIG. 5, the worker mutually rotates the hinge members 7,8 to keep the hinge members 7,8 in a substantially flattened state. Subsequently, the worker inserts the engaging pins 15,16 of the first hinge member 7 into the openings of the slide grooves 32 of the engaging portions 26 on the holder plate 25. Further, the worker disposes the engaging bar 21 of the second hinge member 8 on the guide portions 28,29 of the pinch portions 27 as shown by an arrow in FIG. 5 while sliding the engaging pins 15,16 toward the interior of the slide grooves 32. Subsequently, in this state, the worker pushes the whole of the guide support member 6 or the engaging bar 21 from the upper side and press-fits the engaging bar 21 into the slide grooves 30 so that the engaging bar 21 is rotatably supported. At this time, the first guide portion 28 of the pinch portion 27 is elastically moved in conjunction with the press-fitting of the engaging bar 21 as enable by the groove, so that the engaging bar 21 can be easily pinched and supported by the pinch portions 27. Through this operation, the assembly between the guide support member 6 and the holder plate 25 is completed as shown in FIG. 6.

Figure 8:
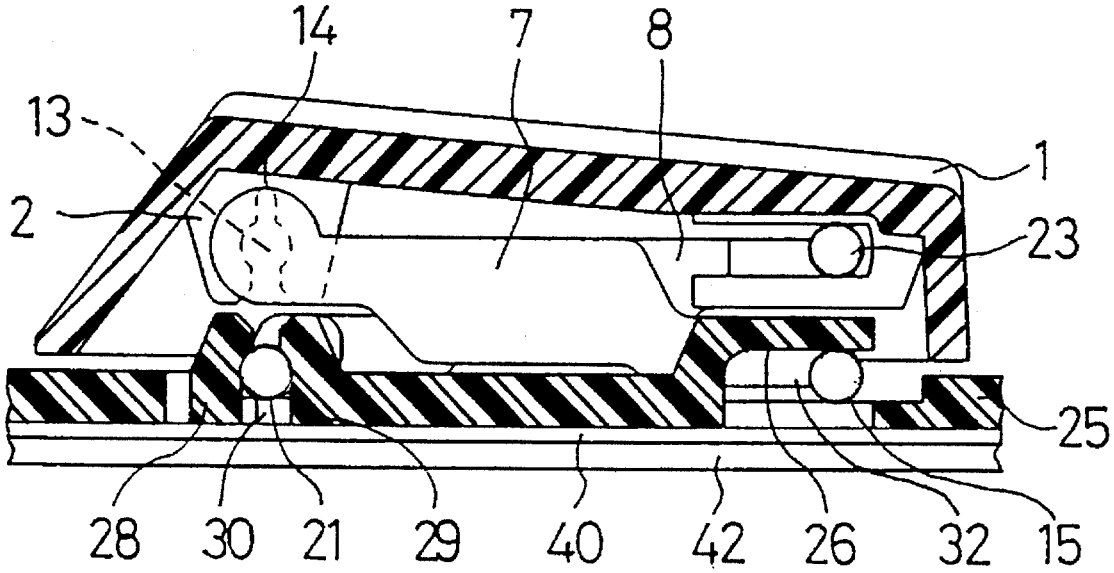
FIG. 8 is a schematic diagram showing a state where the guide support member used for the key switch of the first embodiment is linked to the key top.

Subsequently, the worker mounts the key top 1 on the guide support member 6. At this time, as shown in FIG. 7, the worker mounts the key top 1 on the guide support member paying attention to ensure that the engaging bar 13 of the first hinge member 7 and the engaging grooves 4 confront one another and that the engaging pins 23,24 of the second hinge member 8 and the engaging grooves 5 of the key top 1 confront one another. Subsequently, the worker further slightly pushes down on the key top 1. Upon this operation, the engaging bar 13 of the first hinge member 7 is engagedly inserted into the engaging grooves 4 while guided by the engaging guide portions 4A. At the same time, the engaging pins 23,24 of the second hinge member 8 are engagedly inserted into the grooves 5 as a result of being guided by the engaging guide portions 5A which force the pins 23,24 toward one another until they pass the edges of guide portions 5A whereupon they expand into grooves 5. This state is shown in FIG. 8. Through this operation, the assembly of the guide support member 6 and the key top 1 is finished.

Through the series of operations as described above, the fabrication of one key switch is finished. The assembly of the hinge members 7,8 to the holder plate 25 and of the hinge members 7,8 to the key top 1 can be very easily performed. Therefore, the assembly of the key switch is facilitated and the fabrication time is shortened. In addition, the fabrication of the key can be accurately performed.

Next, the operation of the key switch thus structured will be described.

Upon depression of the key top 1, the engaging bar 13 is counterclockwisely rotated in the engaging holes 4 of the engaging portions 2 of the first hinge member 7, in conjunction with the downward motion of the key top 1, and the engaging pins 23,24 of the second hinge member 8 are horizontally slid in the engaging grooves 5 of the engaging portions 3. At the same time, the engaging bar 21 of the second hinge member 8 is clockwisely rotated in the slide grooves 30 of the pinch portions 27 of the holder plate 25 and the engaging pins 15,16 of the hinge member 7 are horizontally slid in the slide grooves 32 of the engaging portions 26. As a result, the shaft support portions 6A, pivotally supporting the first and second hinge members 7,8, are depressed and the push-down portion 18 gradually compresses the rubber spring 35, so that the rubber spring 35 buckles when the push-down amount exceeds a predetermined threshold level. Through this operation, the movable electrode 35A in the rubber spring 35 short-circuits the switch electrode 40A on the flexible circuit board 40 and a predetermined switching operation is executed.

Upon release of the push-down of the key top 1, the shaft support portions 6A of the first and second hinge members 7,8 are upwardly moved by an elastic restoring force of the rubber spring 35. Through this operation, the engaging bar 13 and the engaging pins 15,16 of the first hinge member 7 and the engaging bar 21 and the engaging pins 23,24 of the second hinge member 8 are operated in the inverse manner to the depression operation, so that the key top 1 is returned to its original position.

In this case, the engaging bars 13,21 are not horizontally moved but are rotated in the engaging grooves 4 and the slide grooves 30, respectively. Therefore, the key top 1 is upwardly and downwardly moved without being moved horizontally and the key face is kept horizontal.

Figure 9A:
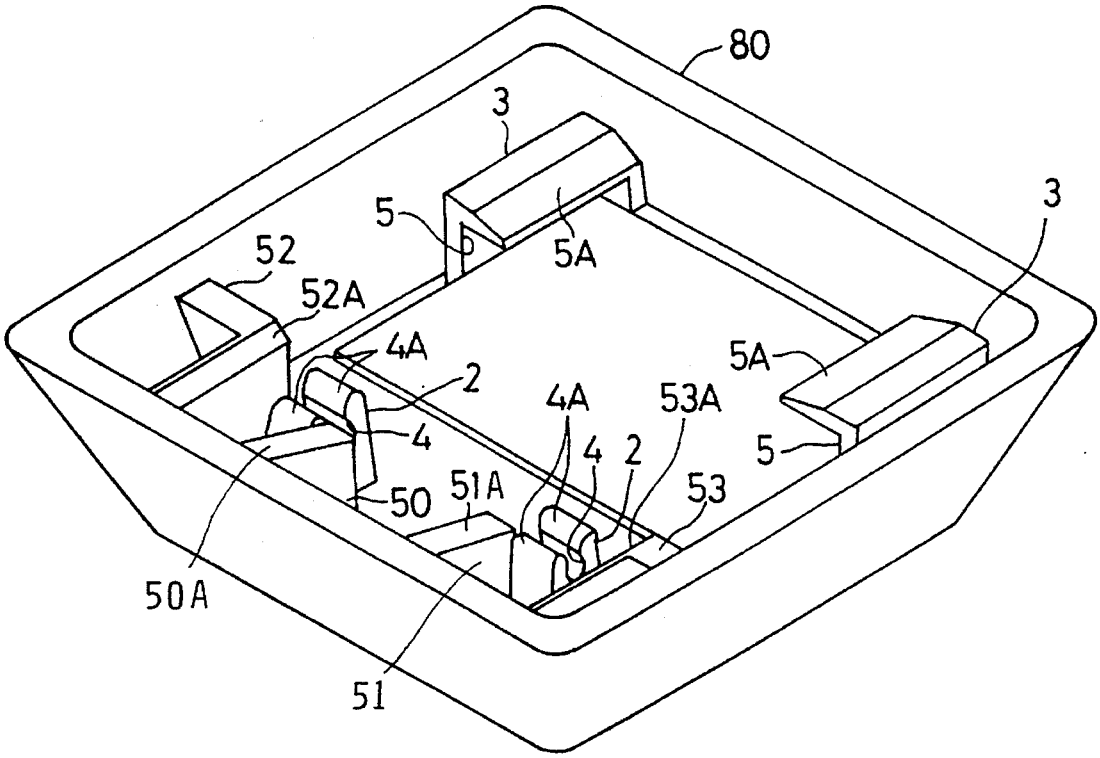
FIG. 9A is a perspective view of the back face side of the key top used for a key switch of a second embodiment.
Figure 9B:
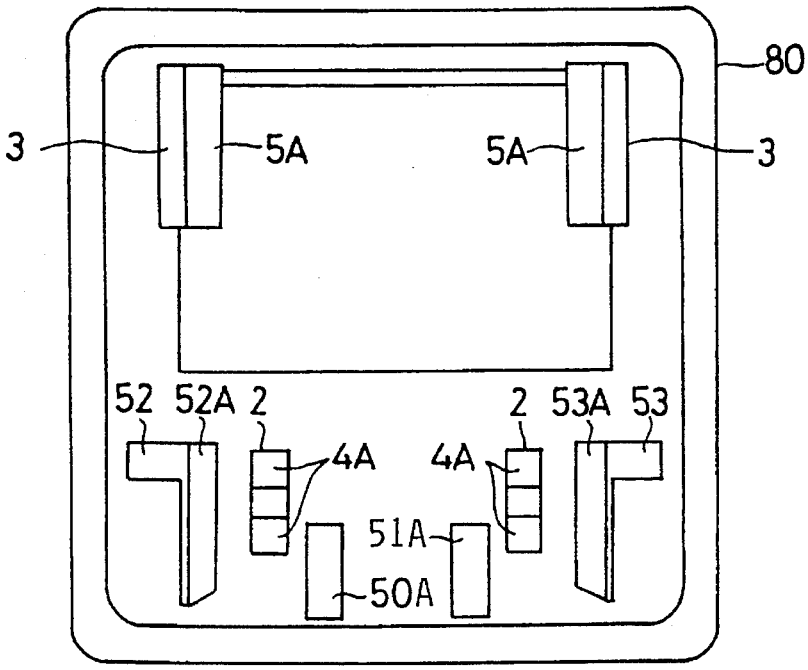
FIG. 9B is a plan view of the back face side of the key top used for the key switch of the second embodiment.

Next, a second embodiment of the key switch according to this invention will be described with reference to FIGS. 9A and 9B.

The key switch of the second embodiment is different from the first embodiment only in the construction of the key top. That is, the second embodiment uses a key top 80 as shown in FIGS. 9A and 9B. The same elements of the key top 80 as the key top of the first embodiment are represented by the same reference numerals. The description of those elements is omitted. The only differences between the first and second embodiments reside in ribs 50,51,52,53 that are provided to the key top of the second embodiment.

The ribs 50,51 are formed between the two engaging portions 2 so as to extend from the side wall of the back face of the key top 80 to the engaging guide portions 4A at the wall sides of the engaging portions 2. Each of the upper surfaces 50A,51A of the ribs 50,51 forms a smooth, slanted surface extending from the side wall of the back face of the key top 80 to a position whose height is substantially equal to the height of the engaging portions 2. Accordingly, the key top of this embodiment is so designed that when the key top 80 is mounted on the guide support member 6 later, the engaging bar 13 is smoothly guided in by the upper surfaces 50A,51A of the ribs 50,51 of the key top 80 to surely mount the engaging bar 13 into the guide portions 4A of the engaging portions 2.

The ribs 52,53 are provided at the outside of the engaging portions 2 respectively and have a substantially L-shaped section in a plan view. The upper surface of the ribs 52,53 is located at substantially the same height as the engaging portions 2 and has slant surface portions 52A,53A which smoothly and slantly descend toward the engaging portions 2, respectively. Accordingly, when the key top 80 is mounted on the guide support member 6 later, one or the other ends of the engaging bar 13 is smoothly guided in the left or right directions of the key top 80 by one of the slant surface portions 52A,53A of the ribs 52,53, so that both end portions of the engaging bar 13 can be surely mounted between the ribs 52,53.

The steps up to the work of assembling the key top 80 and the guide support member 6 (the steps as shown in FIG. 6) in this second embodiment are identical to those of the first embodiment and the description thereof is omitted.

Figure 10:
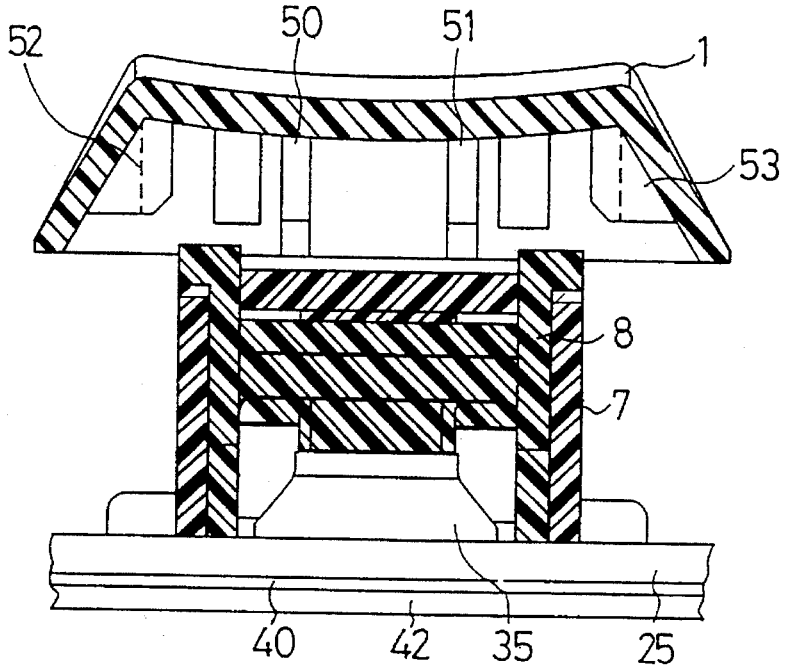
FIG. 10 is a schematic diagram showing a state just before the key top used for the key switch of the second embodiment is mounted on the guide support member.
Figure 11:
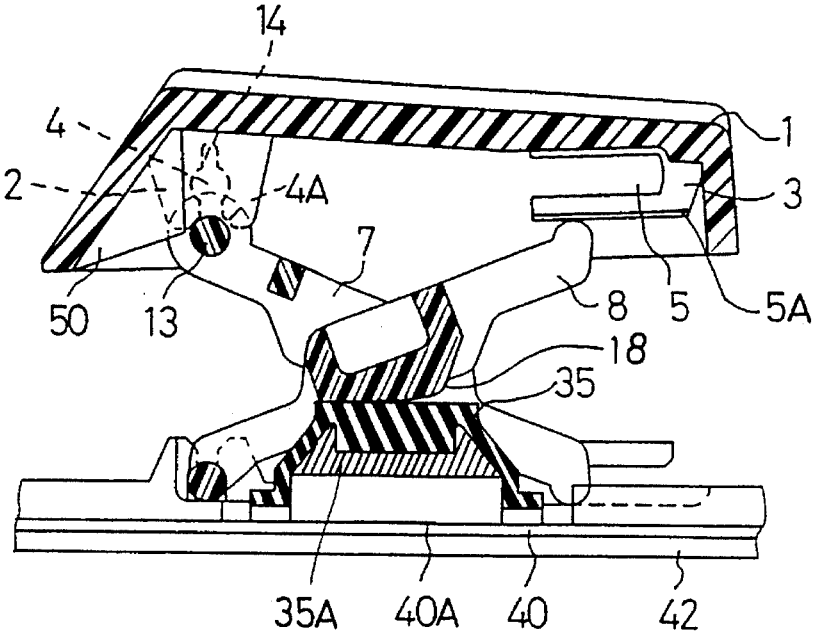
FIG. 11 is a schematic diagram showing a state where the key top used for the key switch of the second embodiment is being mounted on the guide support member.

As shown in FIG. 6, the worker mounts the key top 80 onto the guide support member 6 when the guide support member 6 is linked to the base portion 70. FIG. 10 is a schematic diagram just before the key top 80 is mounted on the guide support member 6. When the worker mounts the key top 80 onto the guide support member 6, as described above, the engaging bar 13 of the first hinge member 7 is guided by the ribs 50,51,52,53 to be smoothly and surely mounted onto the guide portions 4A of the engaging portions 2 as shown in FIG. 11. Subsequently, the worker slightly depresses the key top 80. Through this operation, the engaging bar 13 of the hinge member 7 is inserted into the engaging grooves 4 while guided by the engaging guide portions 4A. At the same time, the engaging pins 23,24 are inserted into the engaging grooves 5 after being guided by the engaging guide portions 5A, and the assembly of the guide support member 6 and the key top 80 is finished.

In the second embodiment, the key top 80 is equipped on the back face thereof with the guiding ribs 50,51,52,53, so that the engaging bar 13 of the first hinge member can be more surely, easily and smoothly guided to the guide portions 4A of the engaging portions 2 in comparison with the key switch of the first embodiment.

Figure 12:
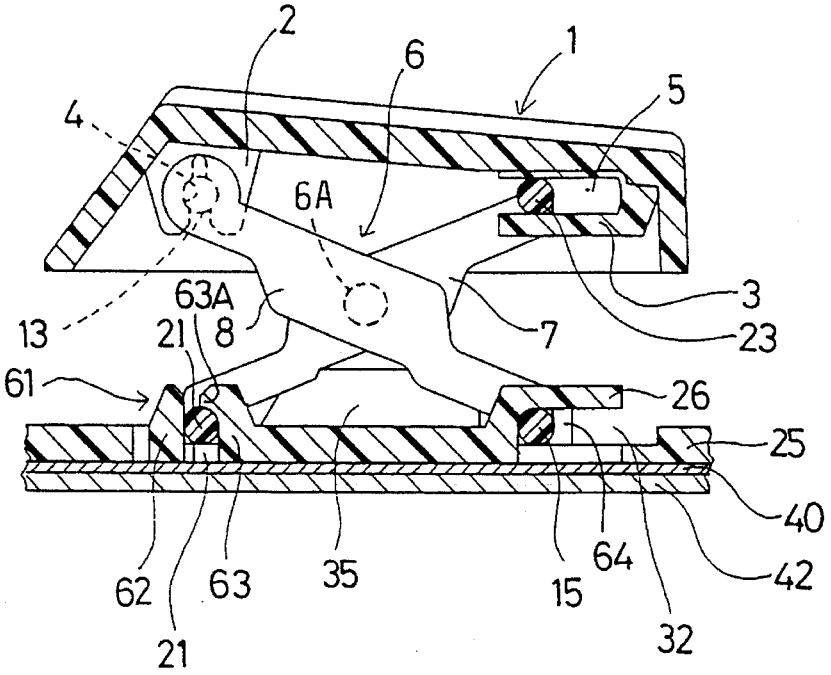
FIG. 12 is a cross-sectional view showing the construction of a key switch of a third embodiment.
Figure 13:
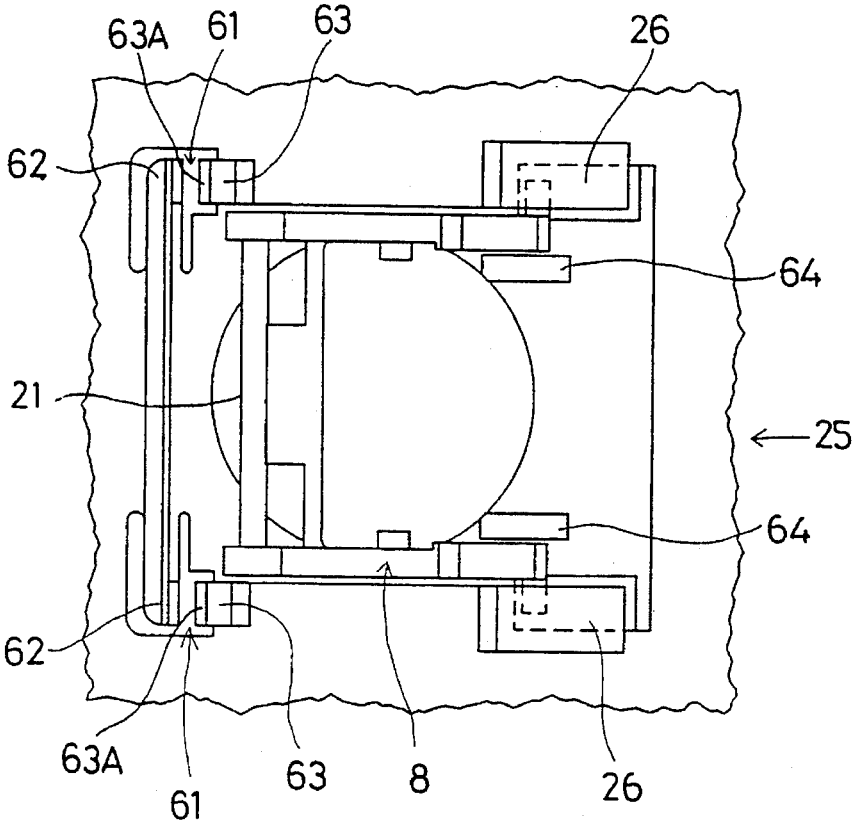
FIG. 13 is a plan view showing a state where a holder plate and a second hinge member used for the key switch of the third embodiment are linked to each other.
Figure 14:
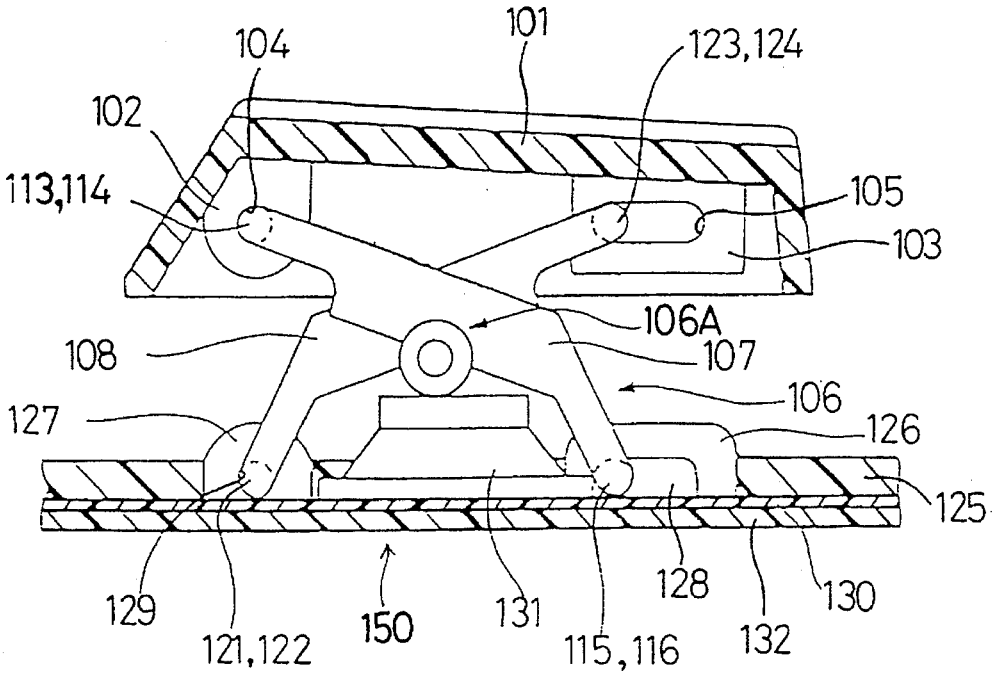
Fig.14 RELATED ART
FIG. 14 is a cross-sectional view showing the construction of a conventional key switch.
Figure 15:
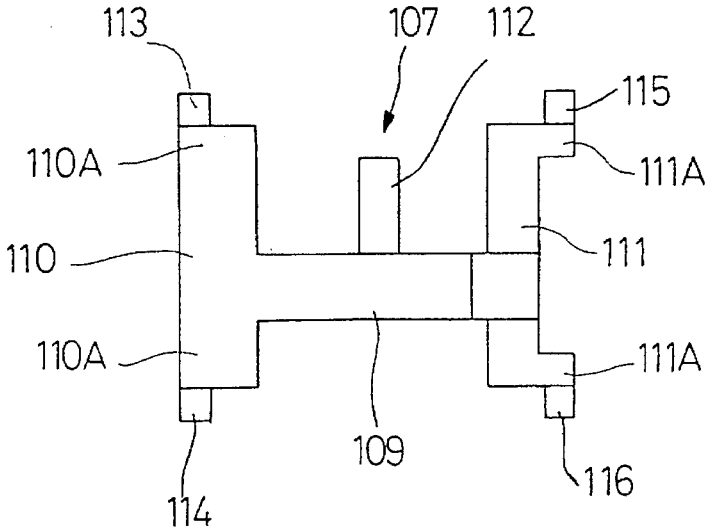
Fig.15 RELATED ART
FIG. 15 is a plan view showing the construction of a first hinge member used for the conventional key switch.
Figure 16:
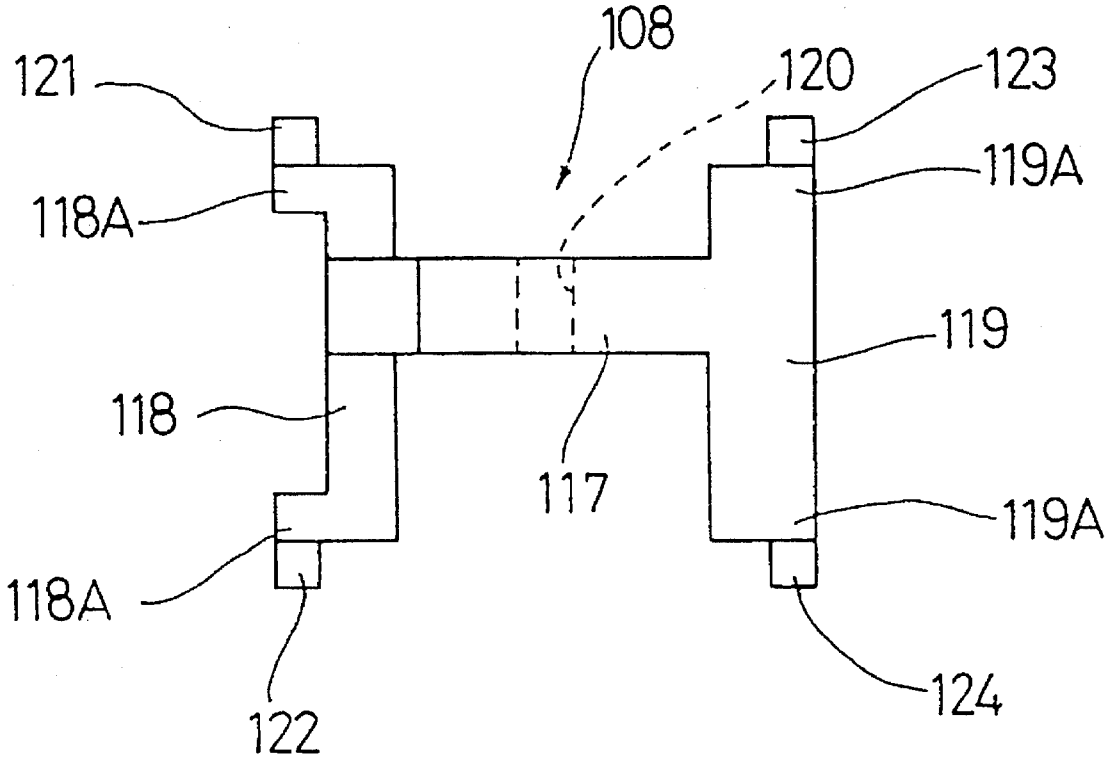
Fig.16 RELATED ART
FIG. 16 is a plan view showing the construction of a second hinge member used for the conventional key switch.

Next, a third embodiment of the key switch according to the invention will be described with reference to FIGS. 12 to 13. In this embodiment, the same elements as those of the key switch of the first embodiment are represented by the same reference numerals and the description thereof is omitted.

The key switch of the third embodiment is different from the key switch of the first embodiment in the structure of the pinch portion 27. As shown in FIGS. 12 to 13, a pinch portion 61 of the third embodiment, replacing pinch portion 27 of the first embodiment, comprises a wall portion 62 and an elastic piece 63. The wall portion 62 is formed over the whole width of the two pinch portions 61 so as to be projected from the holder plate 25. The elastic pieces 63 are projected from the holder plate 25 in the vicinity of both ends of the wall portion 62 which are separated from the body of the holder plate 25 by a groove. The elastic pieces 63 are disposed so as to be aligned with each other and separated from the face surface of the wall portion 62. A central portion of the wall portion 62 is separated from the rubber spring 35 by a predetermined distance. The grooves allow the ends of the wall portion 62 so as to be elastically deformable away from the elastic pieces 63. As shown in FIG. 12, a projection 63A is formed at the upper end of each elastic piece so as to be projected toward the wall portion 62.

Further, in the third embodiment, a bending preventing wall 64, projecting from the holder plate 25 is provided in the neighborhood of the inner side of each engaging portion 26 in such a manner as to be away from the engaging portion 26 at a predetermined interval. The bending preventing wall 64 serves to prevent the engaging pins 15,16 from being detached from the engaging portions 26 due to the bending of the second hinge member 8 inwardly.

According to an assembly method for the key switch of the third embodiment thus structured, like the key switch of the first embodiment, the worker first mounts the flexible circuit board 40 and the holder plate 25 on the switch support plate 42. Each of the shafts 12 of the first hinge member 7 is then engagedly inserted into the corresponding shaft hole 20 to assemble the guide support member 6.

Thereafter, the worker rotates the hinge members 7 and 8 of the guide support member 6 mutually to make the members substantially flat. The worker then inserts the engaging pins 15,16 of the first hinge member 7 from the openings of the slide grooves 32 of the engaging portions 26 into the slide grooves 32 on the holder plate 25. Subsequently, the worker mounts the engaging bar 21 of the second hinge member on the pinch portions 61 while sliding the guide support member 6 toward the interior of the slide grooves 32. In this state, the bending of the hinge member 8 which is directed toward the inside of the plate members 17 is restricted by the bending preventing wall 64, whereby the engaging pins 15,16 are prevented from being detached from the engaging portions 26.

In this state, the engaging bar 21 is press-fitted to the pinch portions 61. At this time, the ends of the wall portion 62 are elastically deformed away from the elastic pieces 63 through the press-fitting and the engaging bar 21 is pinched between the pinch portions 61. In this state, the movement of the engaging bar 21 is restricted by the wall portion 62, and the engaging bar 21 is prevented from being detached from the pinch portions 61 by the projections 63A at the upper ends of the elastic pieces 63. Through the press-fitting, the linking work between the guide support member 6 and the holder plate 25 is finished.

Subsequently, the engaging bar 13 of the hinge member 7 is confronted to the engaging grooves 4 of the key top 1 or 80, and the engaging pins 23,24 of the hinge member 8 are confronted to the engaging grooves 5 of the key top 1 or 80. Thereafter, the key top 1 or 80 is slightly pushed down. Through this operation, the engaging bar 13 of the hinge member 7 is engagedly inserted into the engaging grooves 4, as guided by the engaging guide portions 4A, and at the same time the engaging pins 23,24 of the hinge member 8 are engagedly inserted into the engaging grooves 5, as guided by the engaging guide portions 5A. Through this operation, the linking work between the guide support member 6 and the key top 1 or 80 is finished.

The fabrication of the key switch of the third embodiment is terminated by the above work. Like the key switches of the first and second embodiments, the assembly between each of the hinge members 7,8, the holder plate 25, and the key top 1 or 80 is easily carried out so that the fabrication of the key switch is facilitated, the fabrication time is shortened, and the fabrication is accurately performed.

Next, the case where the key top 1 or 80 of the key switch, fabricated as in the third embodiment, is detached for exchange will be described.

When the worker pulls up the key top 1 or 80, loads are imposed on the engaging pins 15,16,23,24 of the hinge members 7,8, the engaging portions 2,3 of the key top 1 or 80, and the engaging portions 26 and the pinch portions 61 of the holder plate 25. In the pinch portions 61 of the holder plate 25, force is applied to the engaging bar 21 of the first hinge member 7 in the upward and upper right directions as viewed in FIG. 12. Since the engaging bar 21 is held at the right side and upper side by the elastic pieces 63, the engaging bar 21 is prevented from being detached from the pinch portions 61. In the engaging portions 26 of the holder plate 25, force is applied to the engaging pins 15,16 of the second hinge member 8 in the upward and upper left directions. At this time, the plate members 17 of the hinge member 8 are elastically bent inwardly, however, the inward movement of the plate members 17 is restricted by the bending preventing walls 64. On the other hand, in the engaging grooves 4 of the key top 1 or 80, force is applied to the engaging bar 13 of the first hinge member 7 in the downward and lower right directions, as viewed in FIG. 1, and the engaging guide portion 4A is elastically deformed so that the engaging bar 13 is detached from the engaging grooves 4. Further, in the engaging portions 3 of the key top 1 or 80, force is applied to the engaging pins 23,24 of the first hinge member 7 in the downward and lower left directions so that the plate members 9 of the hinge member 7 are elastically bent inwardly and the engaging pins 23,24 are detached from the slide grooves 5 of the engaging portions 3. As a result, only the key top 1 or 80 is detached from the guide support member 6. Thus, the key top 1 or 80 can be replaced by another key top. At this time, the guide support member 6 is not detached from the holder plate 25. Accordingly, in the third embodiment, only the key top 1 or 80 can be surely detached from the key switch.

This invention is not limited to the above embodiments, and various modifications may be made to the embodiments without departing from the subject matter of the invention. For example, the engaging bar 21 of the hinge member 8 of the first embodiment may be an engaging pin formed in each plate member 17. Further, the pinch portion formed in the holder plate of the first embodiment may perform its pinching operation using only the elasticity which is inherent to the resin of the first and second guide portions.

What is claimed is:

1. A key switch, comprising:

a key top having a face on which characters may be presented and a reverse face at the opposite side of said face having a mounting portion thereon;

a guide support having a first hinge member and a second hinge member pivotally attached to one another to operate in a scissors like manner, a first end of said first hinge member mounted to said opposite face of said key top and a second end of said second hinge member mounted to said opposite face of said key top;

a holder plate mounting a second end of said first hinge member and a first end of said second hinge member, and a switching member between said key top and said holder plate which is actuated by movement of said key top toward said holder plate, wherein said holder plate has an elastically deformable mounting member for engaging and retaining a one of said second end of said first hinge member and said first end of said second hinge member.

2. The key switch as claimed in claim 1, wherein said holder plate comprises:

a pair of pinch portions; and a pair of engaging portions.

3. The key switch as claimed in claim 2, wherein each engaging portions of said pair of engaging portions has an engaging guide portion as an outer surface over an engaging groove therein to guide a portion of said guide support member into said engaging groove.

4. The key switch as claimed in claim 3, wherein each pinch portion of said pair of pinch portions comprises a pair of engaging guide portions defining a cylindrical opening therebetween and each engaging guide portion of said pair of engaging guide portions has an engaging groove, said engaging groove open to a side toward an opposing engaging guide portion of said pair of engaging guide portions and an open end substantially opposing a pinch portion of said pair of pinch portions, wherein a one of said pair of engaging guide portions is said elastically deformable mounting member.

5. The key switch as claimed in claim 4, wherein each engaging guide portion of said pair of pinch portions has a smooth curved surface at an end.

6. The key switch as claimed in claim 5, wherein each said pinch portion of said pair of pinch portions has a groove extending from a side of said cylindrical opening opposite said ends of said engaging guide portions having the smooth curved surface.

7. The key switch as claimed in claim 1, wherein said key top is equipped with a guide means for guiding an upper portion of said first hinge member to said mounting portion.

8. The key switch as claimed in claim 1, wherein said first hinge member comprises:

a pair of side plate members, each side plate member having a stub shaft extending from the center portion thereof so the stub shafts oppose one another;

an engaging bar connecting said two side plate members at the first end and an engaging pin extending from an outer side of said plate members at the second end opposite from said engaging bar.

9. The key switch as claimed in claim 8, wherein said second hinge member comprises:

a pair of side plate members, each said side plate member having a shaft hole at a mid point of an outer surface of said side plate member;

an engaging bar connecting said side plate members at the second end, said engaging bar having ends extending beyond an outer surface of said side plate members; and engaging pins extending from an outer surface of said side plate members at the first end of said side plate members opposite from said engaging bar, said guide support being formed when said shaft stubs of said first hinge member engage with said shaft holes of said second hinge member.

10. The key switch as claimed in claim 9, wherein said mounting portion on said key top comprises first and second pairs of mounting members, said engaging bar of said first hinge member is rotatably received in said first pair of mounting members of said key top and said engaging pins of said second hinge member are slidably received in said second pair of mounting members of said key top.

11. The key switch as claimed in claim 10, wherein said holder plate comprises third and fourth pairs of mounting members, said engaging bar of said second hinge member is rotatably retained by one of said third and fourth pairs of mounting members of said holder plate and said engaging pins of said first hinge member are slidably received in the other of said third and fourth pairs of mounting members of said holder plate, the rotatable retention being provided by said elastically deformable mounting member.

12. The key switch as claimed in claim 11, wherein each mounting member of said one of said third and fourth pairs of mounting members comprises a pair of guide portions defining an opening therebetween and each mounting member of said other of said third and fourth pairs of mounting members has an engaging groove, said engaging groove open to a side toward an opposing mounting member of said other of said third and fourth pairs of mounting members and an open end opening away from a mounting member of said other of said third and fourth pairs of mounting members.

13. A key switch, comprising:

a key top having a face and a back surface;

a first pair of mounting members on said back surface;

a second pair of mounting members on said back surface;

a base having an open switch thereon;

a third pair of mounting members on said base;

a fourth pair of mounting members on said base;

a guide support linking said key top and said base for engaging with said first through fourth pairs of mounting members, said guide support comprising a first hinge member and a second hinge member; and a movable electrode mounted on said base, said movable electrode engaging said open switch upon depression of said key top, wherein at least one of said first and second pairs of mounting members is a pair of engaging members, each engaging member having a groove between said back surface of said key top and a surface of an engaging guide portion of said engaging member, said engaging guide portion having a second surface away from said groove, said second surface being slanted so as to guide said guide support into engagement with said groove when mounting said key top to said guide support.

14. A key switch, comprising:

a key top having a face and a back surface;

a first pair of mounting members on said back surface;

a second pair of mounting members on said back surface;

a base having an open switch thereon;

a third pair of mounting members on said base;

a fourth pair of mounting members on said base;

a guide support linking said key top and said base for engaging with said first through fourth pairs of mounting members, said guide support comprising a first hinge member and a second hinge member; and a movable electrode mounted on said base, said movable electrode engaging said open switch upon depression of said key top, wherein at least one pair of said first and second pairs of mounting members is a pair of locking members, each locking member having a pair of opposing engaging pieces separated by an engaging groove leading to an opening for holding said guide support, each said engaging piece having a smooth curved surface at an end defining a beginning of said engaging groove.

15. The key switch as claimed in claim 14, wherein said back surface of said key top has a first pair of guide ribs having a surface sloped toward said engaging groove to guide said guide support into said engaging groove.

16. The key switch as claimed in claim 15, wherein said back surface of said key top has a second pair of guide ribs, each guide rib of said second pair of guide ribs adjacent one of said at least one pair of locking members such that said pair of locking members are between said second pair of guide ribs, each said guide rib of said second pair of guide ribs having a surface sloped towards said adjacent locking member, said second pair of guide ribs centering said key top on said guide support.

17. The key switch as claimed in claim 14, wherein said back surface of said key top has a first pair of guide ribs, each guide rib of said first pair of guide ribs is adjacent one of said at least one pair of locking members such that said pair of locking members are between said first pair of guide ribs, each said guide rib of said first pair of guide ribs having a surface sloped towards said adjacent locking member, said first pair of guide ribs centering said key top on said guide support.

18. The key switch as claimed in claim 17, wherein said back surface of said key top has a second pair of guide ribs having a surface sloped toward said engaging groove to guide said guide support into said engaging groove.

19. A key switch, comprising:

a key top having a face and a back surface;

a first pair of mounting members on said back surface;

a second pair of mounting members on said back surface;

a base having an open switch thereon;

a third pair of mounting members on said base;

a fourth pair of mounting members on said base;

a guide support linking said key top and said base for engaging with said first through fourth pairs of mounting members, said guide support comprising a first hinge member and a second hinge member; and a movable electrode mounted on said base, said movable electrode engaging said open switch upon depression of said key top, wherein at least one of said third and fourth pairs of mounting members are a pair of engaging members, each engaging member having a groove between said base and an engaging portion of said engaging member, said groove open at an end away from an opposing mounting member of the other one of said third and fourth pairs of mounting members.

20. The key switch as claimed in claim 19, wherein each mounting member of said first pair of mounting members comprises a pair of engaging portions defining a cylindrical opening therebetween and each mounting member of said second pair of mounting members has an engaging groove, said engaging groove open to a side toward an opposing mounting member of said second pair of mounting members and an open end substantially opposing a mounting member of said first pair of mounting members.

* * * * *